US010527008B2

(12) United States Patent
Kim et al.

(10) Patent No.: US 10,527,008 B2
(45) Date of Patent: Jan. 7, 2020

(54) DIAGNOSTIC METHOD FOR DIAGNOSING STICKING OF CANISTER PURGE VALVE AND AUTOMOTIVE DIAGNOSTIC SYSTEM THEREFOR

(71) Applicant: HYUNDAI AUTRON CO., LTD., Seongnam-si (KR)

(72) Inventors: Dong-Ha Kim, Uiwang-si (KR); Jong-Seok Kim, Anyang-si (KR)

(73) Assignee: Hyundai Autron Co., Ltd, Seoul (KR)

( * ) Notice: Subject to any disclaimer, the term of this patent is extended or adjusted under 35 U.S.C. 154(b) by 0 days.

(21) Appl. No.: 15/206,414

(22) Filed: Jul. 11, 2016

(65) Prior Publication Data

US 2017/0009706 A1 Jan. 12, 2017

(30) Foreign Application Priority Data

Jul. 10, 2015 (KR) ..... 10-2015-0098522

(51) Int. Cl.

*F02M 25/08* (2006.01)
*F02M 35/10* (2006.01)
*F02D 41/00* (2006.01)

(52) U.S. Cl.

CPC ..... *F02M 25/0827* (2013.01); *F02D 41/0045* (2013.01); *F02M 25/0836* (2013.01); *F02M 35/10386* (2013.01)

(58) Field of Classification Search

CPC ..... F02M 25/0836; F02M 35/10386; F02D 41/0045

See application file for complete search history.

(56) References Cited

U.S. PATENT DOCUMENTS

2004/0250805 A1* 12/2004 Osanai ..... F02D 41/004 123/698
2004/0261765 A1* 12/2004 Osanai ..... F02D 41/0045 123/325

FOREIGN PATENT DOCUMENTS

CN 1450962 A 10/2003
CN 102678396 A 9/2012
DE 100 43 071 A1 3/2002
DE 10 2006 008 051 B3 11/2007

(Continued)

OTHER PUBLICATIONS

Korean Intellectual Property Office, Office Action for Korean patent application No. 10-2015-0098522, dated Aug. 1, 2016, Korea.

(Continued)

*Primary Examiner* — Xiao En Mo
(74) *Attorney, Agent, or Firm* — Baker & Hostetler LLP; Hyunho Park

(57) ABSTRACT

Disclosed is a diagnostic method of diagnosing sticking of a canister purge valve comprising steps of: controlling opening and closing of the canister purge valve in order to diagnose sticking of the canister purge valve and calculating a throttle learning value for acquiring variation in an air inflow amount based on an intake air pressure sensor and an throttle opening amount in each of control sections; comparing the throttle learning values calculated in each of control sections and acquiring variation in the air inflow amount flowing from the canister purge valve when the canister purge valve is opened and closed; and determining whether the canister purge valve is stuck or not based on the variation in the air inflow amount.

14 Claims, 9 Drawing Sheets

(56) References Cited

FOREIGN PATENT DOCUMENTS

| | | | |
|---|---|---|---|
| JP | 05-272418 | A | 10/1993 |
| JP | 07-119557 | A | 5/1995 |
| JP | 09-166053 | A | 6/1997 |

OTHER PUBLICATIONS

German Patent and Trademark Office, Office Action for German patent application No. 10 2016 008 256.9, dated Mar. 10, 2017, Germany.

* cited by examiner

DIAGNOSTIC METHOD FOR DIAGNOSING STICKING OF CANISTER PURGE VALVE AND AUTOMOTIVE DIAGNOSTIC SYSTEM THEREFOR

CROSS REFERENCE TO RELATED APPLICATION

This application claims the benefit of Korean Patent Application No. 10-2015-0098522, filed on Jul. 10, 2015, entitled "STUCK DIAGNOSIS METHOD FOR CANISTER PURGE VALVE AND VEHICLE SYSTEM THEREFOR", which is hereby incorporated by reference in its entirety into this application

BACKGROUND

1. Technical Field

The present invention relates to a diagnostic method for diagnosing sticking of a canister purge valve and an automotive diagnostic system therefor. More specifically, the present invention relates to a diagnostic method for diagnosing sticking of a canister purge valve and an automotive diagnostic system therefor, which enable to diagnose sticking of a canister purge valve without using a fuel tank pressure sensor and even during non-idling conditions.

2. Description of the Related Art

Because of acceleration of environmental pollution, regulations on exhaust emissions that have a significant impact on atmospheric pollution tend to strengthen day by day in the automotive industry. Each country in the world has forced car manufacturers to reduce exhaust emissions through strengthening of various regulations and particularly has mandatory requirements that vehicles be equipped with monitoring and fault diagnostic capability for emission-related parts, such as on-board diagnostics (OBD) regulations.

Emissions from automobile vehicles include, in addition to combustion gas discharged mainly through a muffler, unburnt gas discharged from a crank case and evaporative gas that is generated when fuel in a fuel tank evaporates as the outside temperature increases.

The evaporative gas from the fuel tank among those emissions is composed of hydrocarbon (HC) and hence acts as an air pollutant causing depletion of the ozone layer and the like. Therefore, in automobile vehicles, the evaporative gas generated due to evaporation of the fuel is collected and stored in activated carbon having strong adsorptive force, which is called as a canister, and then introduced into intake air by driving a canister purge valve to be burned when an engine is operated.

That is, recovery of the evaporative gas depends on whether or not the canister purge valve is working normally. Therefore, major automobile consuming countries require, through regulations, that the canister purge valve be diagnosed as to whether it is working normally or not.

Diagnosis of sticking of the canister purge valve is to diagnose whether the canister purge valve is working normally.

In the prior art, the following approaches have been used for diagnosis of sticking of the canister purge valve.

First, the canister purge valve is diagnosed by monitoring values measured by a tank pressure sensor when leakage of a fuel tank is diagnosed during idling state of a vehicle. When the canister purge valve is in normal operation, negative pressure is formed in the fuel tank. Possibility of diagnosis of sticking of the canister purge valve depends on whether or not the negative pressure is formed below a predetermined reference value.

This approach has a problem in that the diagnosis must be carried out only under the idling state because values of the pressure sensor value fluctuates when the vehicle is running. Further, it has also a problem in that in case of a system that does not carry out diagnosis of leakage, the system cannot be used in diagnosing sticking of the canister purge valve because of the absence of a pressure sensor.

Second, the canister purge valve is diagnosed based on variation in an amount of air flowing into an engine, an air-fuel ratio of the air and fuel mixture and an ignition angle when the canister purge valve is operating during running of the vehicle. Evaporative gas component in the canister is mixed with air and then flows into the engine when the canister purge valve is in normal operation. As a result, variation in the amount of the inflow air and the air-fuel ratio are detected by an engine air quantity sensor (a hot film type sensor or a manifold absolute pressure type sensor) and an oxygen sensor respectively. In this case, in order to maintain the engine output that will be influenced by the fuel component additionally flowing into the engine the same as previous output, an engine control unit controls the ignition angle of the engine to be retarded. It is possible to diagnose sticking of the canister purge valve by using such characteristics. However, this approach has a problem in that the canister purge valve can be diagnosed only in some areas where the engine output is low since the amount of air flowing into the engine by the canister purge valve accounts for a very small proportion compared with the amount of air flowing into the engine through an engine throttle.

SUMMARY

An object of the present invention is to provide a diagnostic method for diagnosing sticking of a canister purge valve and an automotive diagnostic system therefor, which enable diagnosis of sticking of the canister purge valve without using a tank pressure sensor and under non-idling conditions.

Objects of the present invention are not limited to the above-described object, and other objects not described herein will be more clearly understood by those skilled in the field of art pertaining to the embodiments proposed in the following description.

In according with one aspect of the present invention, a diagnostic method of diagnosing sticking of a canister purge valve comprises steps of: controlling opening and closing of the canister purge valve in order to diagnose sticking of the canister purge valve and calculating a throttle learning value for acquiring variation in an air inflow amount based on an intake air pressure sensor and an throttle opening amount in each of control sections; comparing the throttle learning values calculated in each of control sections and acquiring variation in the air inflow amount flowing from the canister purge valve when the canister purge valve is opened and closed; and determining whether the canister purge valve is stuck or not based on the variation in the air inflow amount.

The step of calculating the throttle learning value may comprise steps of: acquiring a first air inflow amount flowing into an engine based on output values of the intake air pressure sensor; acquiring a second air inflow amount flowing into the engine depending on the throttle opening amount; and comparing the first air inflow amount with the second air inflow amount and calculating a throttle learning value of the canister purge valve.

The step of calculating the throttle learning value may comprise steps of: calculating a first learning value of the canister purge valve in the first control section where the canister purge valve is set to open; calculating a second throttle learning value of the canister purge valve in the second control section where the canister purge valve is set to be switched from opening to closing; and calculating a third throttle learning value of the canister purge valve in the third control section where the canister purge valve is set to be switched from closing to opening.

In the step of acquiring variation in the air inflow amount, the variation in the air inflow amount can be acquired based on the first throttle learning value, the second throttle learning value and the third throttle learning value.

In the step of determining whether the canister purge valve is stuck or not, if the air inflow amount is varied such an extent that a difference between the third throttle learning value and the first throttle learning value is smaller than a predetermined first threshold value and a difference between the second throttle learning value and the first throttle learning value is greater than a predetermined second threshold value, it is determined that the canister purge valve is stuck.

If the steady state condition is maintained in each of the control section, the step of calculating the throttle learning value may proceed to a next control section.

In the step of calculating the throttle learning value, a control factor value for determining whether or not the steady state condition is satisfied can be stored at the end point of each of the control sections.

The control factor value includes the throttle learning value and may include at least one of the number of engine rotation, an intake air amount of an engine, a target intake air amount of an engine, a throttle opening amount and a throttle opening target value.

In the step of calculating the throttle learning value, the control factor values except for the throttle learning value, which are acquired in each of the control sections, are compared with each other between adjacent control sections and if a difference therebetween is equal to or smaller than a threshold value, the throttle learning values can be compared with each other.

The diagnostic method for diagnosing sticking of the canister purge valve further comprises a step of determining whether or not a diagnosis activation condition of the canister purge valve is satisfied during running of a vehicle, wherein the diagnosis activation condition includes a condition that a primary diagnosis for diagnosing sticking of the canister purge valve, based on a proportion that a fuel quantity compensating value accounts for in a total fuel injection amount under the state that the canister purge valve is opened above a certain flow rate, fails; a condition that a certain period of time elapses after the preceding diagnosis is carried out; a condition that both the air inflow amount and the throttle learning amount become stable; a condition that flow rate of the canister purge valve is a certain amount or more; a condition that a level of canister loading is a certain level or less; and a condition that catalyst temperature is equal to or higher than a certain temperature.

In accordance with another aspect of the present invention, a diagnostic method for diagnosing sticking of a canister purge valve comprises steps of: carrying out a primary diagnosis for diagnosing sticking of the canister purge valve, based on a proportion that a fuel quantity compensating value accounts for in a total fuel injection amount under the state that the canister purge valve is opened above a certain flow rate; and carrying out a secondary diagnosis for diagnosing sticking of the canister purge valve, in which opening and closing of the canister purge valve are controlled in the respective control step of a plurality of control steps and throttle learning values calculated for acquiring variation in an air inflow amount of an engine are monitored based on an intake air pressure sensor and a throttle opening amount in each of control sections.

The steps of carrying out the primary diagnosis and the secondary diagnosis may be carried out when a common condition is satisfied wherein the common condition includes a condition that diagnosis of the canister purge valve is not completed, a condition that the intake air pressure sensor and an atmospheric pressure sensor are in a steady state, a condition that the number of engine rotation is constant, a condition that altitude is equal to or less than a certain level, a condition that voltage of a vehicle battery is normal, and a condition that temperatures of the outside air and engine cooling water are normal.

The step of carrying out the primary diagnosis may be carried out when conditions that a level of canister loading is constant and flow rate of the canister purge valve is equal to or greater than a predetermined flow rate are satisfied.

The step of carrying the secondary diagnosis may be carried out when an air amount test condition is satisfied wherein the air amount test condition includes a condition that the result of the primary diagnosis fails; a condition that a certain period of time elapses after the preceding diagnosis is carried out; a condition that both the air inflow amount and the throttle learning amount become stable; a condition that flow rate of the canister purge valve is a certain amount or more; a condition that a level of canister loading is a certain level or less; and a condition that catalyst temperature is equal to or higher than a certain temperature.

The step of carrying out the secondary diagnosis may comprise steps of: controlling opening and closing of the canister purge valve and calculating throttle learning values in each of control sections in order to diagnose sticking of the canister purge valve; comparing the throttle learning values calculated in each of control sections with each other and acquiring variation in an air inflow amount flowing from the canister purge valve when the canister purge valve is opened and closed; and determining whether the canister purge valve is stuck or not based on the variation in the air inflow amount.

In accordance with still another aspect of the present invention, the present invention provides an automotive diagnostic system for diagnosing sticking of a canister purge valve comprising: a canister for collecting evaporative gas generated in a fuel tank; a canister purge valve for supplying the evaporative gas in the canister to an engine intake port; an intake air pressure sensor for measuring an intake air amount flowing into an engine; and an engine control unit for performing control for diagnosing sticking of the canister purge valve, wherein the engine control unit controls opening and closing of the canister purge valve and calculates throttle learning values for acquiring variation in an air inflow amount flowing into the engine based on an intake air pressure sensor and an throttle opening amount in each of control sections; compares the throttle learning values calculated in each of control sections with each other and acquires variation in an air inflow amount flowing from the canister purge valve when the canister purge valve is opened and closed; and determines whether the canister purge valve is stuck or not based on the variation in the air inflow amount.

The engine control unit may acquire a first air inflow amount flowing into the engine based on output values of the intake air pressure sensor; acquire a second air inflow amount flowing into the engine depending on the throttle opening amount; and compare the first air inflow amount with the second air inflow amount and then calculate a throttle learning value of the canister purge valve.

According to the present invention, diagnosis of sticking of a canister purge valve can be performed even without using a tank pressure sensor by carrying out a primary diagnosis based on a proportion that a fuel quantity compensating value accounts for in a total fuel injection amount under the state that the canister purge valve is opened above a certain flow rate and a secondary diagnosis in which opening and closing of the canister purge valve are controlled in the respective control step of a plurality of control steps and throttle learning values calculated for acquiring variation in an air inflow amount of an engine are monitored based on an intake air pressure sensor and a throttle opening amount in each of control sections.

According to the present invention, since the diagnosis can be made under non-idling conditions and hence can be made even when the flow rate of the canister purge valve is high, there is no need for a separate idle section for diagnosis.

Further, the diagnosis can be made always when the canister purge valve is operating during the steady state of the engine without need of a separate condition (e.g., increase of idle rpm, change of air-fuel ratio, variation in an engine ignition angle, etc.) likely diagnosis of leakage of a fuel tank, so that entry rate of diagnosis is high.

DETAILED DESCRIPTION

Hereinafter, preferred embodiments of the present invention will be described in detail with reference to the accompanying drawings. However, the present invention should not be construed as being limited to the embodiments set forth herein; rather, alternate embodiments included in other retrogressive inventions or falling within the spirit and scope of the present invention can be easily derived through adding, altering, or changing of other components.

Terms used in the present invention are selected as far as possible from general terms currently widely used in the art. However, in a specific case, some terms are selected arbitrarily by the applicant. In this case, the detailed meanings thereof are described in the detailed description of the invention and thus, the present invention should be understood based on meanings of the terms rather than simple names of the terms.

That is, the word "comprise(s)" or "comprising" does not exclude the presence of other components or steps in addition to those explicitly recited.

Figure 1:
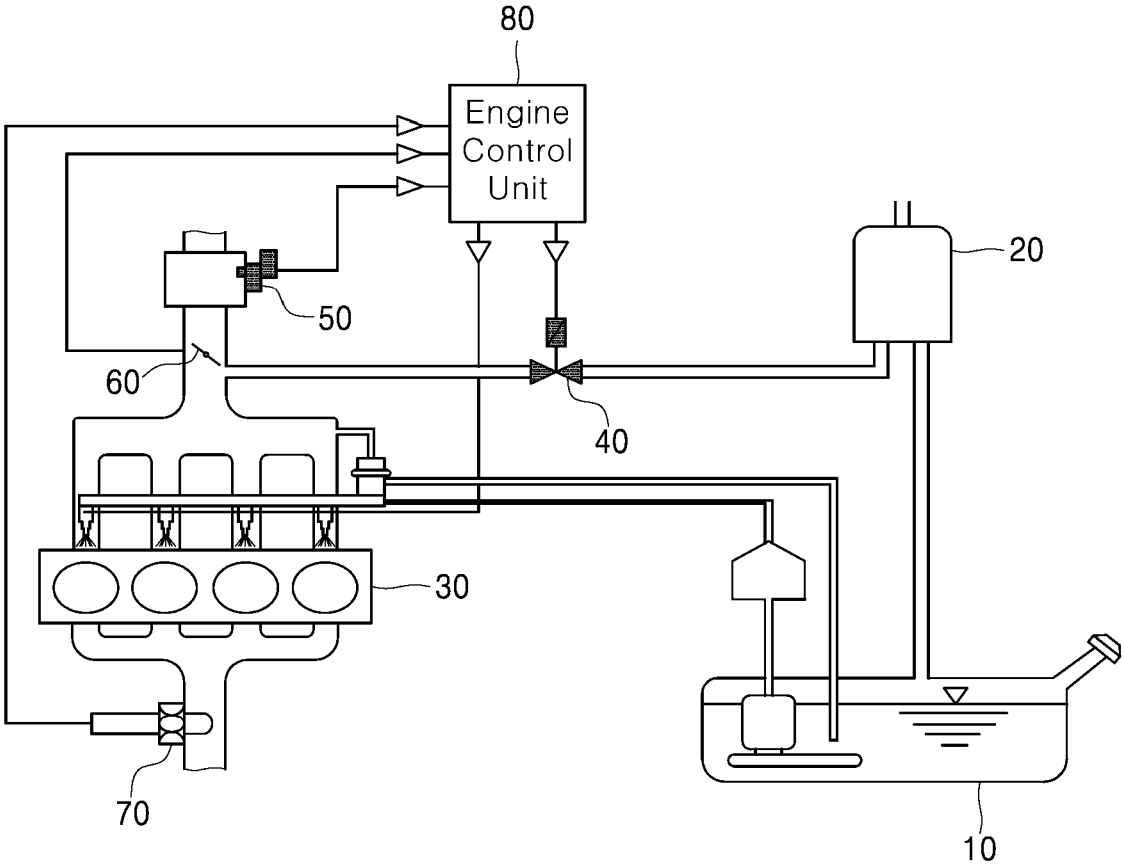
FIG. 1 is a schematic diagram illustrating an automotive diagnostic system for performing diagnosis of sticking of a canister purge valve, according to an embodiment of the present invention.

FIG. 1 is a schematic diagram illustrating an automotive diagnostic system for performing diagnosis of sticking of a canister purge valve, according to an embodiment of the present invention.

Referring to FIG. 1, an automotive diagnostic system for performing diagnosis of sticking of a canister purge valve, according to an embodiment of the present invention, may comprise a fuel tank 10, a canister 20, a canister purge valve (CPV) 40, an intake air pressure sensor 50, a throttle 60, an oxygen sensor 70, and an engine control unit (ECU) 80.

The canister 20 collects evaporative gas generated in the fuel tank 10. A canister purge valve (CPV) (40) serves to supply the vaporized gas of the canister 20 to the intake of an engine 30. The intake air pressure sensor 50 is a sensor for measuring an intake air amount flowing into the engine 30. The oxygen sensor 70 measures combustion air-fuel ratio of the engine. The engine control unit (ECU) 80 performs overall control for diagnosis of sticking of the canister purge valve.

The engine control unit 80 may be configured to perform a primary diagnosis process (i.e., process of testing an air and fuel mixture) and a secondary diagnosis process (i.e., process of testing an air amount).

The primary diagnosis may correspond to testing an air and fuel mixture for diagnosing sticking of the canister purge valve, based on a proportion that a fuel quantity compensating value accounts for in a total fuel injection amount under the state that the canister purge valve 40 is opened above a certain flow rate.

The secondary diagnosis may correspond to testing an air amount for diagnosing sticking of the canister purge valve, in which opening and closing of the canister purge valve 40 are controlled in the respective control step of a plurality of control steps and throttle learning values calculated for acquiring variation in the air inflow amount of the engine based on the intake air pressure sensor 50 and an opening amount of the throttle 60 in each of control sections are monitored.

First, the primary diagnosis by the engine control unit 80 will be described.

The engine control unit 80 can acquire through the oxygen sensor 70 an amount of hydro carbon (HC) of fuel flowing into the engine through the canister purge valve 40 when the canister purge valve 40 operates. The amount of HC is called as a canister load.

The engine control unit 80 subtracts an amount of fuel corresponding to the amount of HC of the fuel, which acquired by the oxygen sensor 70, from a calculated fuel amount and performs fuel injection accordingly.

In the diagnostic process for testing the air and fuel mixture, it is possible to check whether the canister purge valve 40 operates normally by using a series of such performance. That is, when the canister purge valve 40 is opened above a predetermined flow rate, if the fuel amount compensating value exceeds a specific proportion that the fuel amount compensating value accounts for in a total fuel injection quantity, it can be assumed that the canister purge valve is working normally. For example, a specific proportion that the fuel amount compensation value accounts for in the total fuel injection quantity may be set to 10%.

It is possible to check whether or not the canister purge valve 40 is working normally when the canister purge valve 40 operates through the primary diagnosis by the engine control unit 80.

However, the amount of HC flowing from the canister 20 may be small since the amount of the evaporative gas in the fuel tank 10 may be small even when the canister purge valve 40 is working normally. In this case, since the compensating amount of the fuel amount is small, there is a need for a way to check whether or not the canister purge valve is working normally and whether or not the canister purge valve is stuck.

In this case, it is possible to check whether or not the canister purge valve is working normally through the secondary diagnosis by the engine control unit 80.

Thus, if the canister purge valve is not passed at the primary diagnosis, the secondary diagnosis can be alternatively carried out.

The intake air amount flowing into the engine 30 can be controlled through the opening amount of the throttle 60. Since air flows into the engine through a path other than the throttle 60 when the canister purge valve 40 operates, the engine control unit 80 can control the intake air amount of the engine by changing the opening amount of the throttle 60 by the opening amount of the canister purge valve 40.

The intake air amount of the engine can be acquired in two ways.

As a first way, it is possible to acquire the intake air amount by converting output values acquired by the intake pressure sensor 50 to an air amount. As a second way, it is possible to acquire the intake air amount through the opening amount of the throttle 60.

The engine control unit 80 acquires the intake air amount through the intake air pressure sensor 50 during normal operation. Further, in order to operate the engine 30 even when the intake air pressure sensor 50 fails, the engine control unit learns through comparing between the intake air amount acquired from the intake pressure sensor 50 and the air quantity acquired through the opening amount of the throttle 60.

The engine control unit 80 uses throttle learning values acquired by executing the learning of the intake air amount derived from the intake pressure sensor 50 and the opening amount of the throttle 60 as a major factor, thereby determining whether the canister purge valve is stuck to closing.

For example, when opening amount of the canister purge valve 40 is large and behavior of the engine 30 is in a steady state, the canister purge valve can be controlled to be closed or opened in a relatively short time. In this case, the opening amount of the throttle 60 varies to the extent of flow rate flowing into the engine from the canister purge valve 40 and the throttle learning values will have a constant transition.

When the canister purge valve 40 is stuck, control to the throttle 60 after the canister purge control valve 40 is controlled to be closed is carried out the same as in the normal state. However, since there is no air inflow through the canister purge valve 40 and hence the amount of air flowing into the engine 30 is small, variation occurs in the opening amount of the throttle and the throttle learning values.

Therefore, the engine control unit 80 can acquire an intake air amount flowing into the engine from the canister purge valve 40 by comparing between throttle learning values at the time of opening and closing of the canister purge valve 40 in the case where the behavior of the engine 30 is steady and hence there is no variation in the intake air amount due to other factors.

Diagnosis of the canister purge valve by the engine control unit 80 may be performed when the following condition is satisfied.

The common condition for the primary diagnosis and the secondary diagnosis to be performed by the engine control unit 80 is as follows:

The common condition includes a condition that diagnosis of the canister purge valve is not completed, a condition that the intake air pressure sensor and an atmospheric pressure sensor are in a steady state, a condition that the number of engine rotation is constant, a condition that altitude is equal to or less than a certain level, a condition that voltage of a vehicle battery is normal, and a condition that temperatures of the outside air and engine cooling water are normal.

The primary diagnosis is carried out by the engine control unit 80 under the condition that a level of canister loading is constant and flow rate of the canister purge valve is equal to or greater than a predetermined flow rate.

The secondary diagnosis is carried out by the engine control unit 80 under the condition as follows:

A condition that the primary diagnosis fails; a condition that a certain period of time elapses after the preceding diagnosis is carried out; a condition that both the air intake amount and the throttle learning amount become stable; a condition that flow rate of the canister purge valve is a certain amount or more; a condition that a level of canister loading is a certain level or less; or a condition that catalyst temperature is equal to or higher than a certain temperature.

Figure 2:
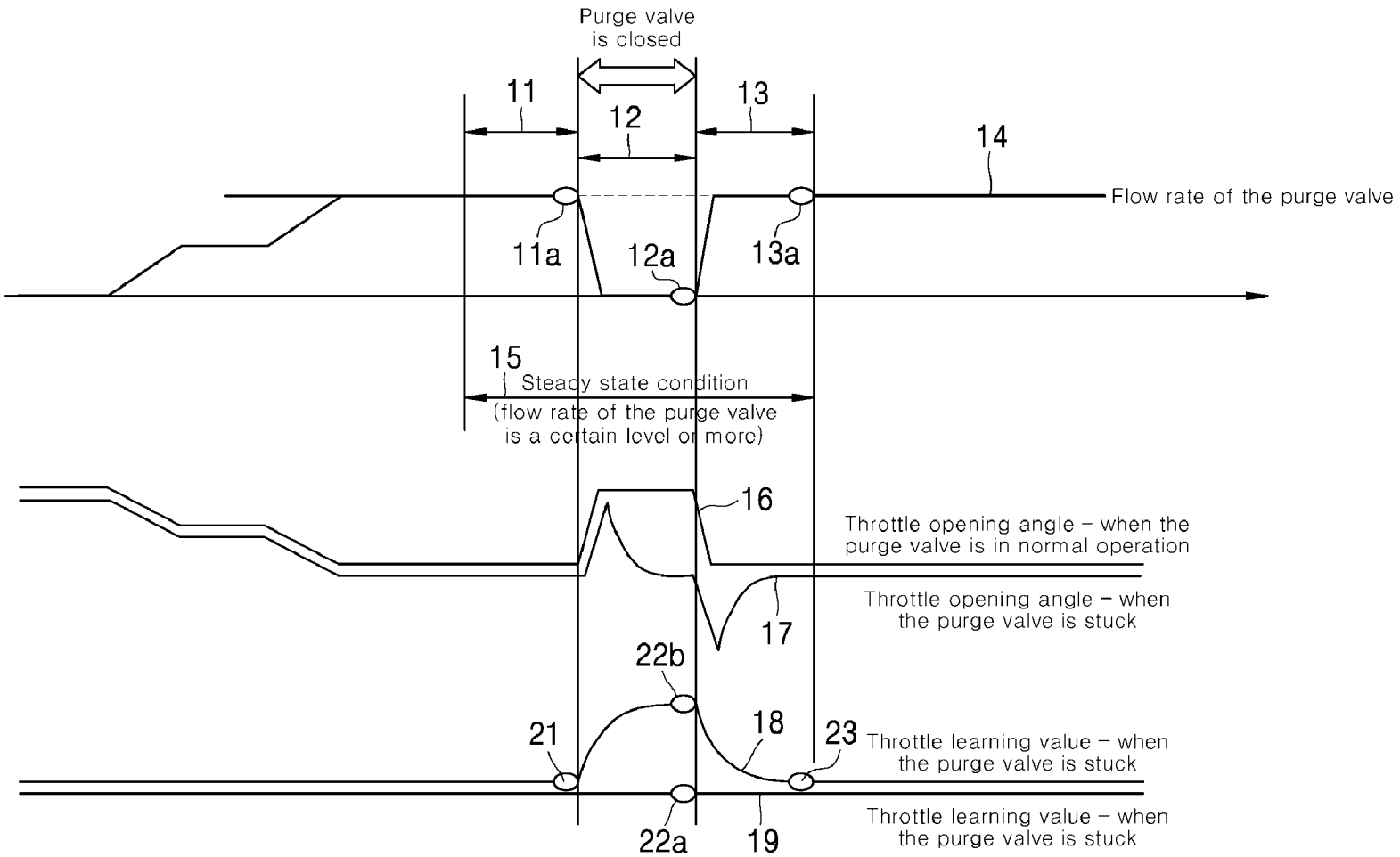
FIG. 2 is a diagram illustrating diagnosis of sticking of a canister purge valve, according to an embodiment of the present invention.

FIG. 2 is a diagram illustrating diagnosis of sticking of a canister purge valve, according to an embodiment of the present invention.

Referring to FIG. 2, the canister purge valve is controlled to be opened or closed in order to diagnose sticking of the canister purge valve. According to this, throttle learning values for acquiring variation in the air inflow amount of the engine 30 are calculated based on the intake air pressure sensor 50 and the opening amount of the throttle 60 in a first control section 11, a second control section 12, and a third control section 13, and then diagnosis of sticking of the canister purge valve 40 is performed. In this case, reference numeral 14 denotes flow rate of the canister purge valve 40, which means a degree of opening of the canister purge valve 40.

Each of the first control section 11, the second control section 12 and the third control section 13 may proceed to a next control section when the steady state condition 15 is maintained in each of the control sections. In this case, the steady state condition means a condition that the flow rate of the canister purge valve is more than a specific level and operation condition of the vehicle is stable.

As can be seen from the figure, there is a difference between open angles 16 and 17 of the throttle 60 during normal operation and in the event of failure. The reference numeral 16 denotes a throttle open angle during normal operation of the canister purge valve and the reference numeral 17 denotes a throttle open angle in the event of failure of the canister purge valve.

In addition, it can be seen that there is variation in throttle learning values 18 and 19 during normal operation and in the event of failure. The reference numeral 18 denotes a throttle learning-value curve representing variation in throttle learning values in the event of failure of the canister purge valve and the reference numeral 19 denotes a throttle learning-value curve representing variation in throttle learning values during normal operation of the canister purge valve.

The first throttle learning value 21 is calculated at the end point 11*a* of the first control section 11, the second throttle learning values 22*a* and 22*b* are calculated at the end point 12*a* of the second control section 12, and the third throttle learning value 23 is calculated at the end point 13*a* of the third control section 13.

Figure 3:
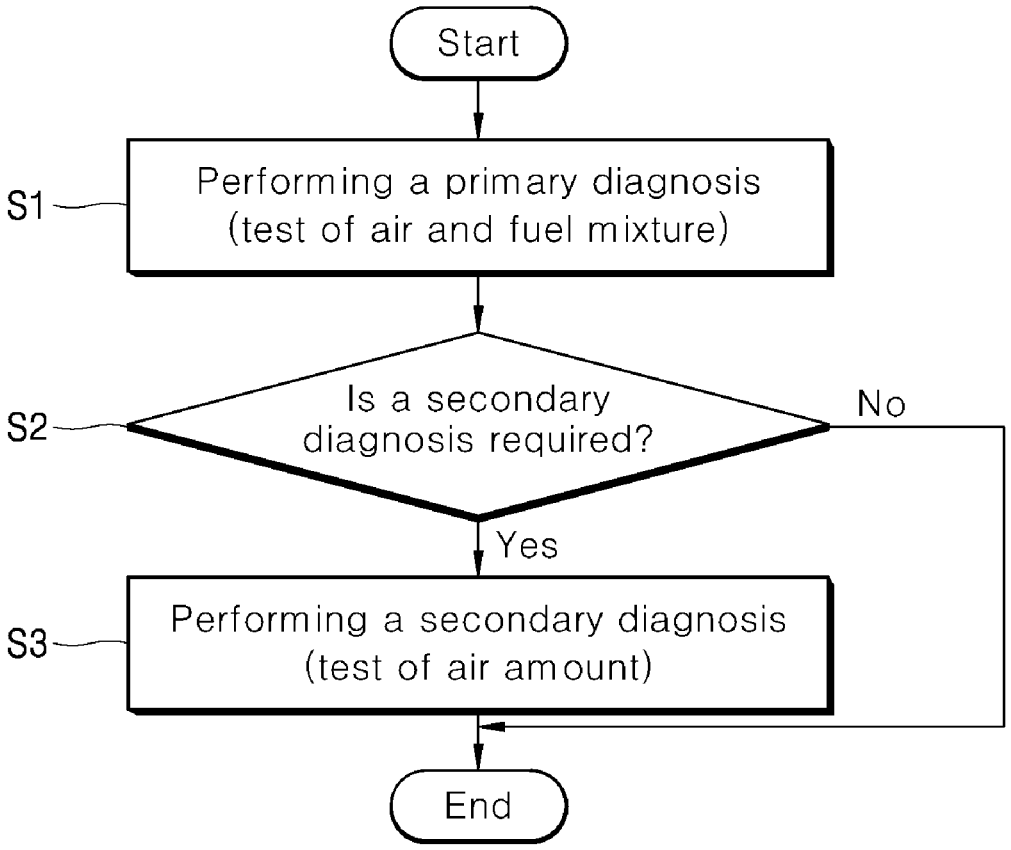
FIG. 3 is a flow chart illustrating diagnosis of sticking of a canister purge valve, according to an embodiment of the present invention.

FIG. 3 is a flow chart illustrating diagnosis of sticking of a canister purge valve, according to an embodiment of the present invention.

Referring to FIG. 3, the primary diagnosis (diagnosis for testing the air and fuel mixture) is carried out in order to diagnose sticking of the canister purge valve (see step S1).

The primary diagnosis performs diagnosis of sticking of the canister purge valve, based on a proportion that a fuel quantity compensating value accounts for in a total fuel injection amount under the state that the canister purge valve 40 is opened above a certain flow rate.

Upon completion of the primary diagnosis, it is determined whether or not the secondary diagnosis is necessary based on the condition for performing the secondary diagnosis (see step S2).

If the secondary diagnosis is required, the secondary diagnosis (test of air amount) is carried out (see step S3).

The secondary diagnosis performs diagnosis of sticking of the canister purge valve, in which opening and closing of the canister purge valve 40 are controlled in the respective control step of a plurality of control steps and throttle learning values calculated for acquiring variation in the air inflow amount of the engine based on the intake air pressure sensor and an opening amount of the throttle 60 in each of control sections are monitored.

Figure 4:
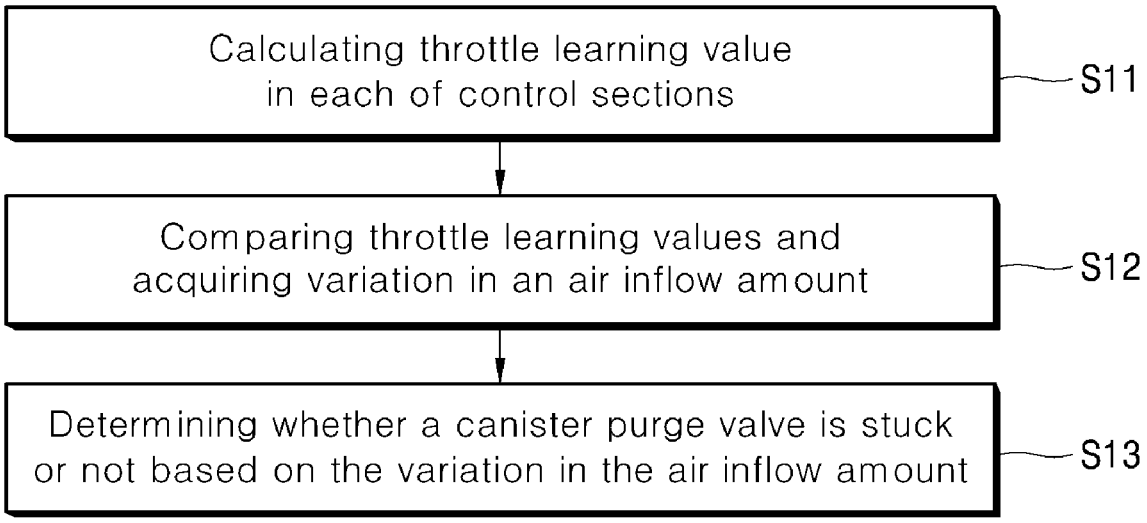
FIG. 4 is a flow chart illustrating a secondary diagnosis in the diagnosis of sticking of a canister purge valve, according to an embodiment of the present invention.

FIG. 4 is a flow chart illustrating a secondary diagnosis in the diagnosis of sticking of a canister purge valve, according to an embodiment of the present invention.

Referring to FIG. 4, in order to diagnose sticking of the canister purge valve by the secondary diagnosis, the engine control unit 80 controls opening and closing of the canister purge valve and calculates a throttle learning value in each of control sections (see step S11).

When the throttle learning value is calculated, the engine control unit 80 compares the throttle learning values calculated in the first control section 11, the second control section 12 and the third control section 13, and acquires variation in the air inflow amount flowing into the engine from the canister purge valve 40 at the time of opening and closing of the canister purge valve (see step S12).

The engine control unit 80 determines whether or not the canister purge valve is stuck based on the variation in the air inflow amount at S13.

Figure 5:
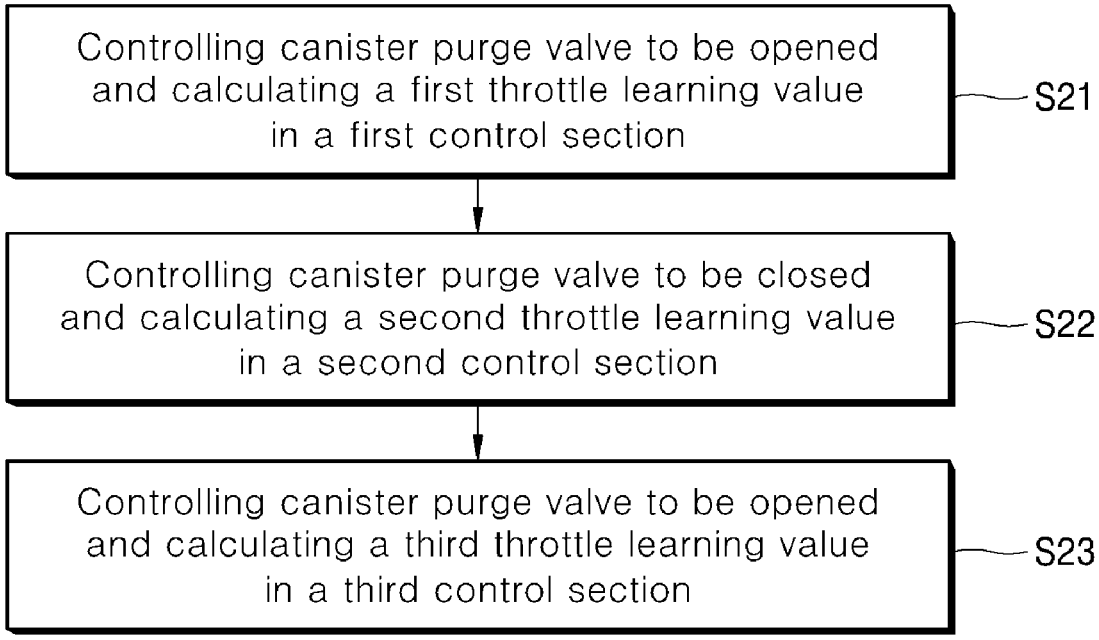
FIG. 5 is a flow chart illustrating calculation of throttle learning values in the diagnosis of sticking of a canister purge valve, according to an embodiment of the present invention.

FIG. 5 is a flow chart illustrating calculation of throttle learning values in the diagnosis of sticking of a canister purge valve, according to an embodiment of the present invention.

Referring to FIG. 5, in order to perform a step S11 for calculating a throttle learning value, the engine control unit 80 controls the canister purge valve 40 to be opened, and calculates a first throttle learning value of the canister purge valve in the first control section 11 (see step S21).

In this case, in order to calculate the first throttle learning value in the first control section 11, the engine control unit 80 acquires a first air inflow amount flowing into the engine 30 based on output values of the intake pressure sensor 50.

The engine control unit 80 acquires a second air inflow amount flowing into the engine by the opening amount of the throttle in the first control section 11.

The engine control unit 80 compares the first air inflow amount and the second air inflow amount and calculates a first throttle learning value of the canister purge valve 40 in the first control section 11.

Similarly, the engine control unit 80 controls the canister purge valve 40 to be switched from opening to closing, and calculates a second throttle learning value of the canister purge valve 40 in the second control section 12 (see step S22).

In this case, in order to calculate the second throttle learning value in the second control section 12, the engine control unit 80 acquires a first air inflow amount flowing into the engine 30 based on output values of the intake pressure sensor 50.

The engine control unit 80 acquires a second air inflow amount flowing into the engine by the opening amount of the throttle 60 in the second control section 12.

The engine control unit 80 compares the first air inflow amount and the second air inflow amount and calculates a second throttle learning value of the canister purge valve 40 in the second control section 12.

Similarly, the engine control unit 80 controls the canister purge valve 40 to be switched from closing to opening, and calculates a third throttle learning value of the canister purge valve 40 in the third control section 13 (see step S23).

In this case, in order to calculate the third throttle learning value in the third control section 13, the engine control unit 80 acquires a first air inflow amount flowing into the engine 30 based on output values of the intake pressure sensor 50.

The engine control unit 80 acquires a second air inflow amount flowing into the engine by the opening amount of the throttle 60 in the third control section 13.

The engine control unit 80 compares the first air inflow amount and the second air inflow amount and calculates a third throttle learning value of the canister purge valve in the third control section 13.

Variation in the air inflow amount can be acquired based on the first throttle learning value, the second throttle learning value and the third throttle learning value.

In determining whether the canister purge valve is stuck or not, if the air inflow amount is varied such an extent that a difference between the third throttle learning value and the first throttle learning value is smaller than a predetermined first threshold value and a difference between the second throttle learning value and the first throttle learning value is greater than a predetermined second threshold value, it is determined that the canister purge valve is stuck.

Figure 6:
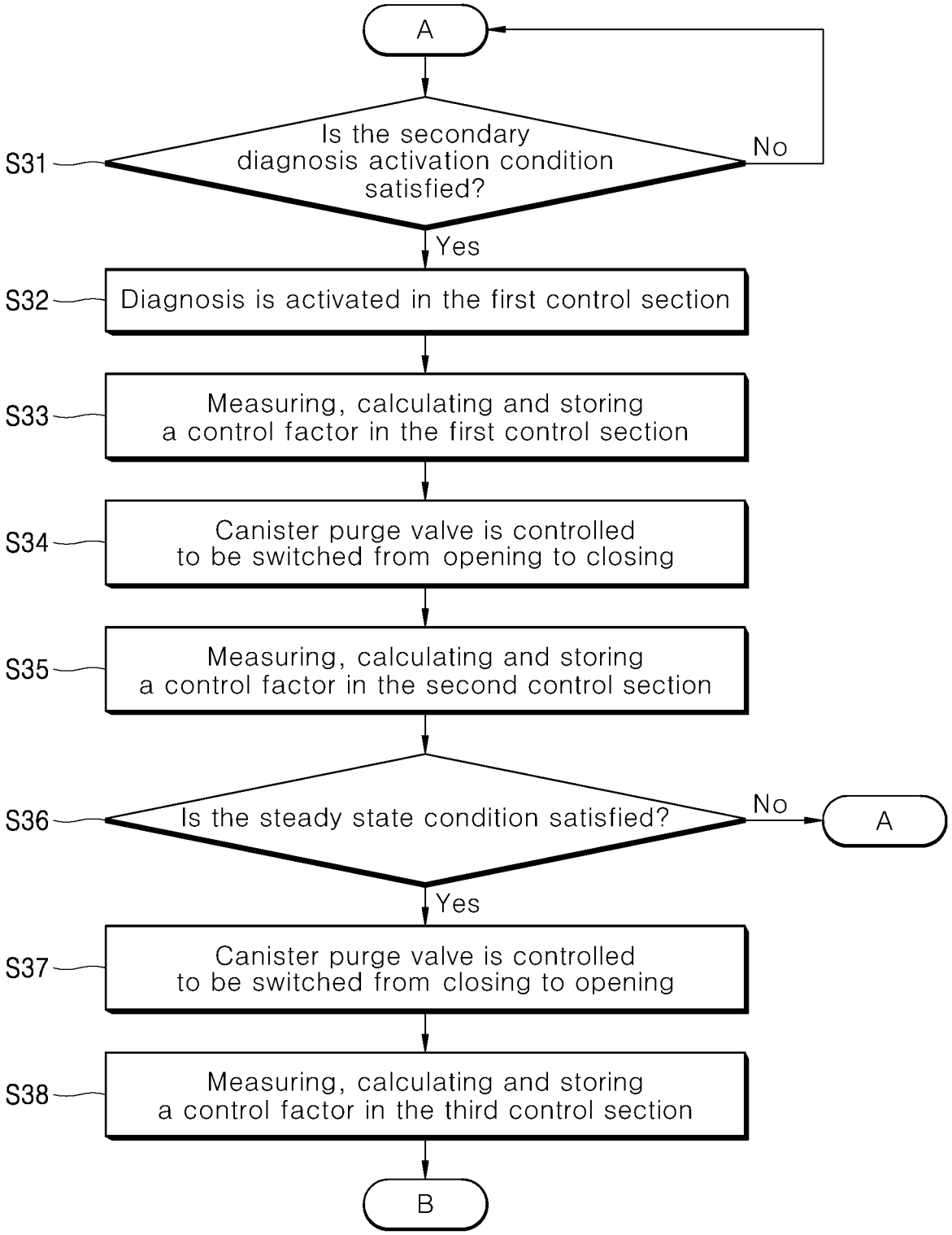
FIGS. 6 and 7 are flow charts illustrating calculation of throttle learning values in the diagnosis of sticking of a canister purge valve, according to an embodiment of the present invention.
Figure 7:
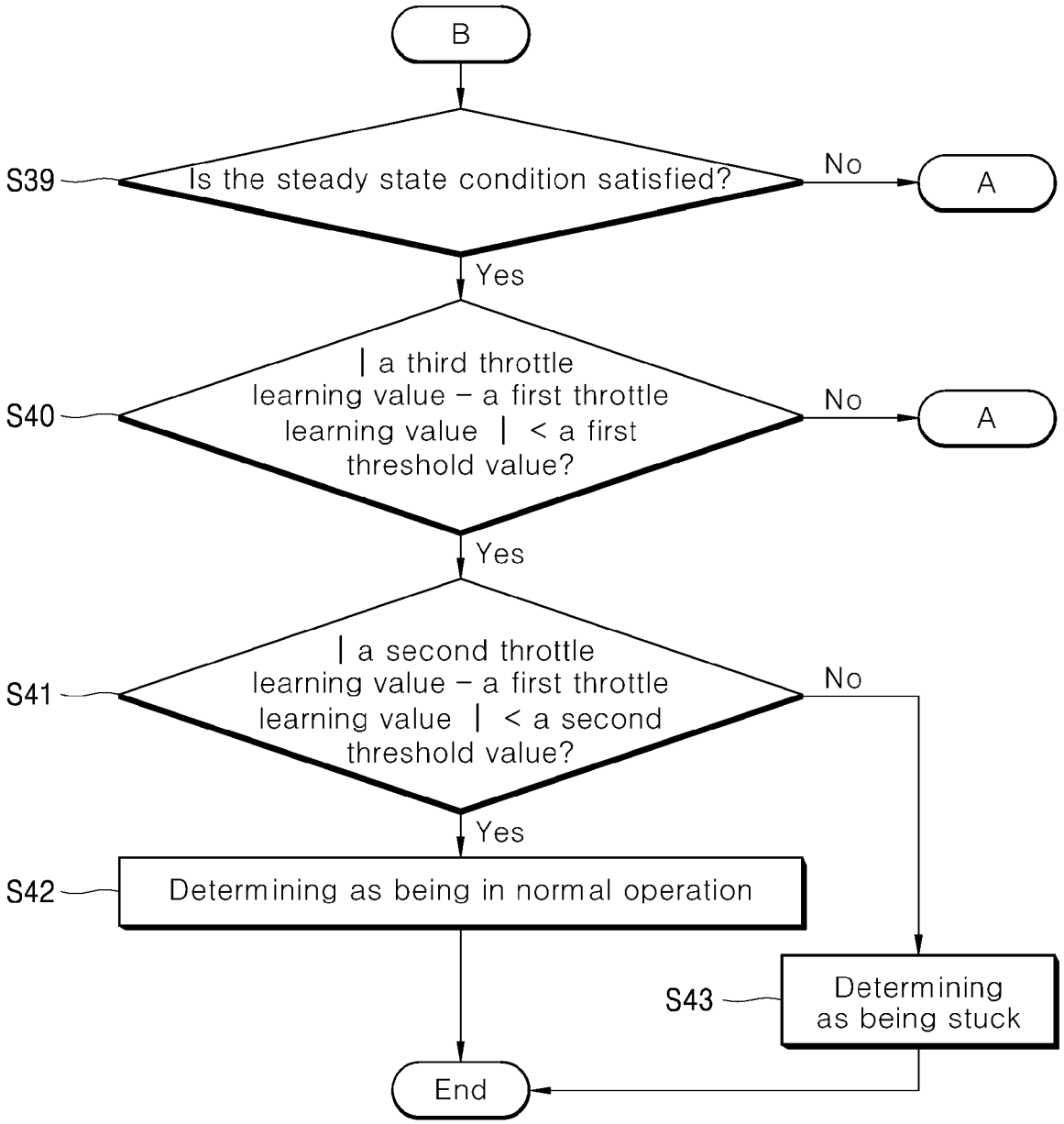

FIGS. 6 and 7 are flow charts illustrating calculation of throttle learning values in the diagnosis of sticking of a canister purge valve, according to an embodiment of the present invention.

Referring to FIGS. 6 and 7, the engine control unit 80 determines whether the secondary diagnosis activation condition is satisfied (see step S31).

The secondary diagnosis activation condition includes a condition that the result of the primary diagnosis fails; a condition that a certain period of time elapses after the preceding diagnosis is carried out; a condition that both the air intake amount and the throttle learning amount become stable; a condition that flow rate of the canister purge valve is a certain amount or more; a condition that a level of canister loading is a certain level or less; and a condition that catalyst temperature is equal to or higher than a certain temperature.

When the secondary diagnosis activation condition is satisfied, the engine control unit 80 activates the diagnosis in the first control section 11 (see step S32). When the secondary diagnosis is activated, the diagnosis proceeds under the state that a steady state condition is maintained. In this case, the steady state condition means a condition that the flow rate of the canister purge valve is more than a specific level and operation condition of the vehicle is stable. For example, a period of time of each of the first control section 11, the second control section 12 and the third control section 13 may be set as two seconds.

The engine control unit 80 measures and calculates a control factor in the first control section 11, and stores the control factor at the end point 11*a* of the first control section 11 (see step S33). The control factor includes the number of engine rotation, an intake air amount of an engine, a target intake air amount of an engine, a throttle opening amount, a throttle opening target value and a throttle learning value.

The engine control unit 80 controls the canister purge valve to be switched from opening to closing in order to proceed to the second control section 12 (see step S34).

The engine control unit 80 measures and calculates a control factor in the second control section 12, and stores the control factor at the end point 12*a* of the second control section 12 (see step S35).

Upon completion of the second control section 12, the engine control unit compares the control factor of the first control section 11 and the control factor of the second control section 12, and determines whether or not the steady state condition is satisfied (see step S36). At this time, it is intended that the throttle learning value be excluded from the control factor.

When it is determined that the steady state condition is satisfied as a result of the comparison between the control factor of the first control section 11 and the control factor of the second control section 12, the engine control unit 80 controls the canister purge valve to be switched from closing to opening (see step S37).

The engine control unit 80 measures and calculates a control factor in the third control section 13, and stores the control factor at the end point 13*a* of the third control section 13 (see step S38).

Upon completion of the third control section 13, the engine control unit 80 compares the control factor of the third control section 13 and the control factor of the second control section 12, and determines whether or not the steady state condition is satisfied (see step S39). At this time, it is intended that the throttle learning value be excluded from the control factor.

The engine control unit 80 determines whether an absolute value of a difference between the third throttle learning value and the first throttle learning value is smaller than a first threshold value (see step S40).

What an absolute value of a difference between the third throttle learning value and the first throttle learning value is smaller than a first threshold value means that the third throttle learning value approaches the first throttle learning value.

When the absolute value of a difference between the third throttle learning value and the first throttle learning value is smaller than the first threshold value, the engine control unit 80 determines whether an absolute value of a difference between the second throttle learning value and the first throttle learning value is smaller than a second threshold value (see step S41).

As a result of the determination, when the absolute value of a difference between the second throttle learning value and the first throttle learning value is smaller than the second threshold value, the engine control unit 80 determines that the caster purge valve is working normally (see step S42).

As a result of the determination, when the absolute value of a difference between the second throttle learning value and the first throttle learning value is greater than the second threshold value, the engine control unit determines that sticking of the caster purge valve occurs (see step S43).

Figure 8:
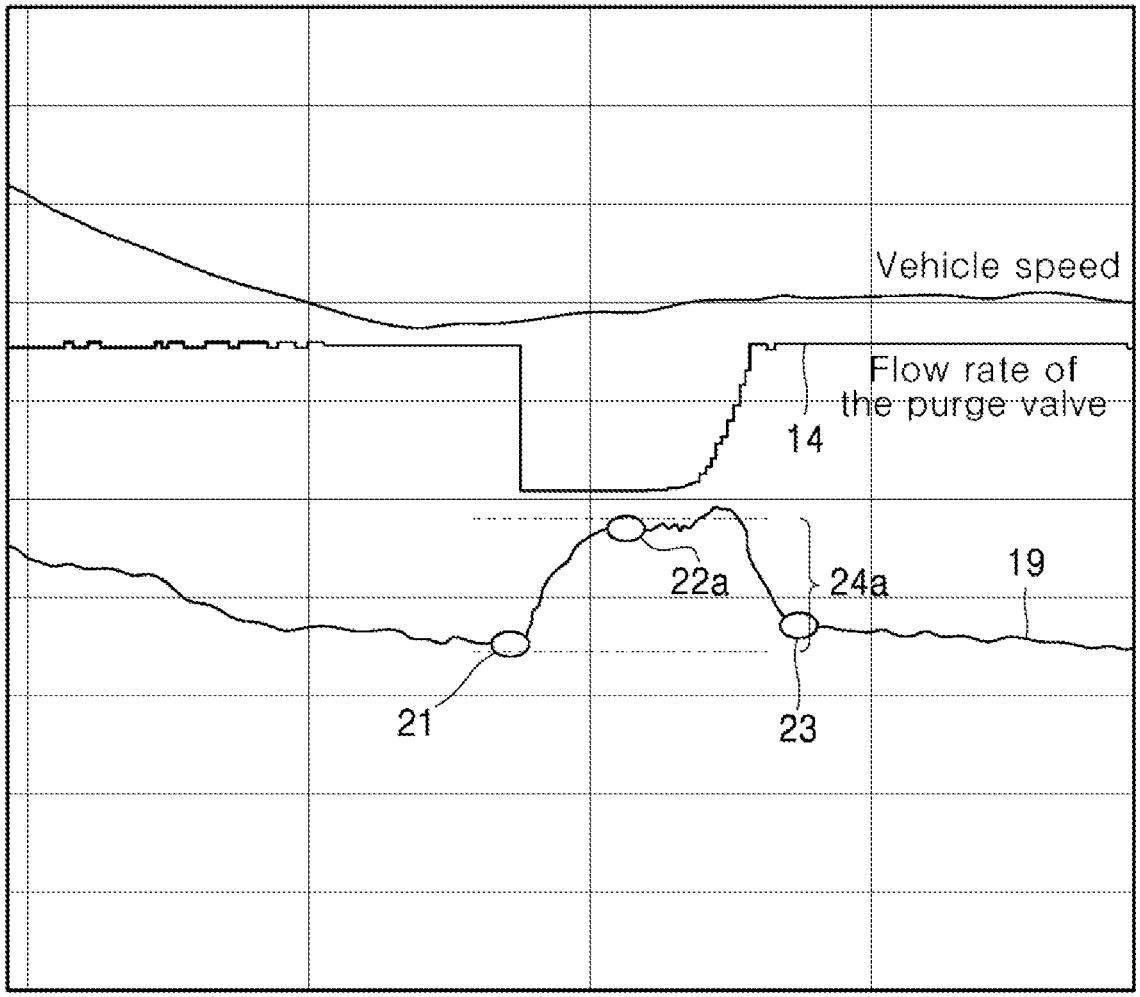
FIG. 8 is a graph illustrating an example that the canister purge valve is determined as being normal as a result of the diagnosis of sticking of a canister purge valve, according to an embodiment of the present invention.

FIG. 8 is a graph illustrating an example that the canister purge valve is determined as being normal as a result of the diagnosis of sticking of a canister purge valve, according to an embodiment of the present invention.

Referring to FIG. 8, as an absolute value of a difference 24*a* between the second throttle learning value 22*a* and the first throttle learning value 21 in a throttle-learning value curve 19 is smaller than a predetermined second threshold value, the engine control unit 80 determines that the canister purge valve is working normally.

Figure 9:
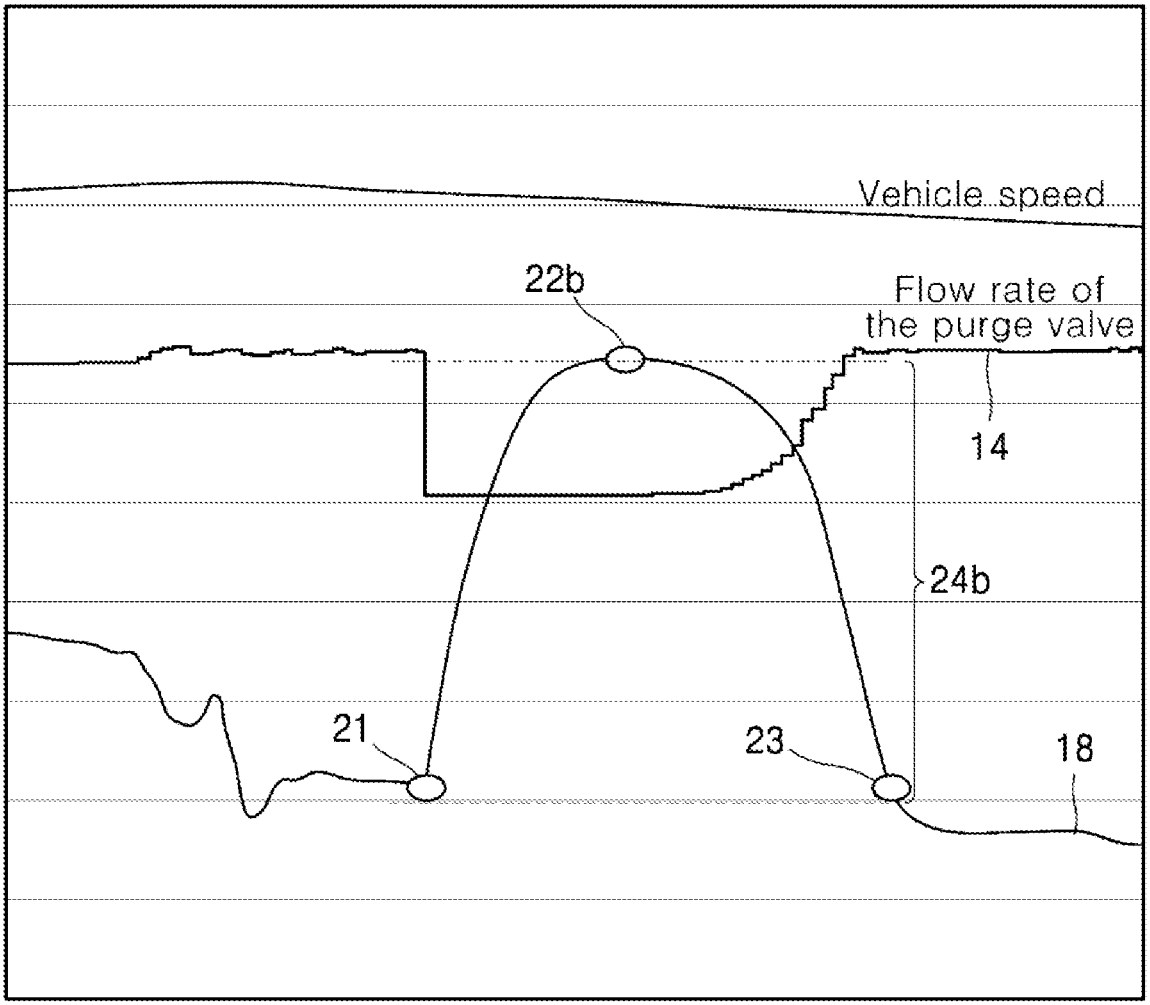
FIG. 9 is a graph illustrating an example that the canister purge valve is determined as being stuck as a result of the diagnosis of sticking of a canister purge valve, according to an embodiment of the present invention.

FIG. 9 is a graph illustrating an example that the canister purge valve is determined as being stuck as a result of the diagnosis of sticking of a canister purge valve, according to an embodiment of the present invention.

Referring to FIG. 9, as an absolute value of a difference 24*b* between the second throttle learning value 22*b* and the first throttle learning value 21 in a throttle-learning value curve 18 is greater than a predetermined second threshold value, the engine control unit 80 determines that the canister purge valve is stuck.

While the present invention has been disclosed with reference to certain embodiments, it will be appreciated by those skilled in the art that numerous modifications, alterations and changes to the present invention can be made without departing from the spirit and scope of the present invention. Accordingly, it is intended that the present invention not be limited to the embodiments disclosed, but it has the full scope defined by the appended claims and equivalents thereof.

What is claimed is:

1. A diagnostic method of diagnosing sticking of a canister purge valve in an automotive diagnostic system in a vehicle comprising:

controlling, by an engine control unit, opening and closing of the canister purge valve in order to diagnose sticking of the canister purge valve, calculating, by the engine control unit, a throttle learning value of the canister purge valve for acquiring a variation of an amount in an air inflow flowing into the engine in each of a first control section, a second control section, and a third control section;

comparing, by the engine control unit, throttle learning values calculated in each of the control sections;

acquiring, by the engine control unit, the variation of the amount in the air inflow flowing into the engine at the time of opening and closing of the canister purge valve; and determining, by the engine control unit, whether the canister purge valve is stuck based on the variation of the amount in the air inflow, wherein the determining comprises:

acquiring an amount of a first air inflow flowing into the engine based on an output value of the intake pressure sensor in one of the control sections, acquiring an amount of a second air inflow flowing into the engine based on an opening angle of the throttle in one of the control sections, and calculating the throttle learning value of the canister purge valve by comparing the amount of the first air inflow with the amount of the second air inflow, and determining whether the canister purge valve is stuck by comparing a variation in the throttle learning value with a threshold value, wherein the automotive diagnostic system in the vehicle uses the determination to monitor the canister purge valve to diagnose a faulty condition to reduce exhaust emissions from the vehicle.

2. The diagnostic method according to claim 1, wherein calculating the throttle learning value comprises:

calculating a first learning value of the canister purge valve in the first control section where the canister purge valve is set to open;

calculating a second throttle learning value of the canister purge valve in the second control section where the canister purge valve is set to be switched from opening to closing; and calculating a third throttle learning value of the canister purge valve in the third control section where the canister purge valve is set to be switched from closing to opening.

3. The diagnostic method according to claim 2, wherein the variation of the amount in the air inflow is acquired based on the first throttle learning value, the second throttle learning value and the third throttle learning value.

4. The diagnostic method according to claim 3, wherein if the amount of the air inflow is varied such an extent that a difference between the third throttle learning value and the first throttle learning value is smaller than a predetermined first threshold value and a difference between the second throttle learning value and the first throttle learning value is greater than a predetermined second threshold value, it is determined that the canister purge valve is stuck.

5. The diagnostic method according to claim 1, wherein if the steady state condition is maintained in each of the control sections, the step of calculating the throttle learning value proceeds to a next control section.

6. The diagnostic method according to claim 5, wherein a control factor value for determining whether the steady state condition is satisfied is saved at the end point of each of the control sections.

7. The diagnostic method according to claim 6, wherein the control factor value includes the throttle learning value and at least one of the number of engine rotation, an intake air amount of an engine, a target intake air amount of an engine, a throttle opening amount and a throttle opening target value.

8. The diagnostic method according to claim 7, wherein the control factor values except for the throttle learning value, which are acquired in each of the control sections, are compared with each other between adjacent control sections and if a difference therebetween is equal to or smaller than a threshold value, the throttle learning values are compared with each other.

9. The diagnostic method according to claim 1, further comprising:

determining whether a diagnosis activation condition of the canister purge valve is satisfied during running of a vehicle, wherein the diagnosis activation condition includes a condition that a primary diagnosis for diagnosing sticking of the canister purge valve, based on a proportion that a fuel quantity compensating value accounts for in a total fuel injection amount under the state that the canister purge valve is opened above a flow rate, fails;

a condition that a period of time elapses after the preceding diagnosis is carried out;

a condition that both the amount of air inflow and the throttle learning value become stable;

a condition that flow rate of the canister purge valve is a predetermined rate or more;

a condition that a level of canister loading is a predetermined level or less; and a condition that catalyst temperature is equal to or higher than a predetermined temperature.

10. A diagnostic method for diagnosing sticking of a canister purge valve in an automotive diagnostic system in a vehicle comprising:

carrying out a primary diagnosis for diagnosing sticking of the canister purge valve, based on a proportion that a fuel quantity compensating value accounts for in a total fuel injection amount under a state that the canister purge valve is opened above a flow rate; and carrying out a secondary diagnosis for diagnosing sticking of the canister purge valve, wherein opening and closing of the canister purge valve are controlled in one of a plurality of control steps and throttle learning values calculated for acquiring a variation of an amount in an air inflow of an engine are monitored based on an intake air pressure sensor and a throttle opening amount in each of the control sections, wherein the primary diagnosis and the secondary diagnosis are carried out when a common condition is satisfied, the common condition including:

a condition that diagnosis of the canister purge valve is not completed, a condition that the intake air pressure sensor and an atmospheric pressure sensor are in a steady state, a condition that the number of engine rotation is constant, a condition that altitude is equal to or less than a predetermined level, a condition that voltage of a vehicle battery is normal, and a condition that temperatures of the outside air and engine cooling water are normal, wherein the automotive diagnostic system in the vehicle uses the primary diagnosis and the secondary diagnosis to monitor the canister purge valve to diagnose a faulty condition to reduce exhaust emissions from the vehicle.

11. The diagnostic method according to claim 10, wherein the primary diagnosis is carried out when conditions that a level of canister loading is constant and flow rate of the canister purge valve is equal to or greater than a predetermined flow rate are satisfied.

12. The diagnostic method according to claim 10, wherein the secondary diagnosis is carried out when an air amount test condition is satisfied, the air amount test condition including a condition that the result of the primary diagnosis fails;

a condition that a period of time elapses after the preceding diagnosis is carried out;

a condition that both the amount of air inflow and the throttle learning value become stable;

condition that flow rate of the canister purge valve is a predetermined flow rate or more;

a condition that a level of canister loading is a predetermined level or less; and a condition that catalyst temperature is equal to or higher than a predetermined temperature.

13. The diagnostic method according to claim 10, wherein carrying out the secondary diagnosis comprises:

controlling opening and closing of the canister purge valve and calculating throttle learning values in each of control sections in order to diagnose sticking of the canister purge valve;

comparing the throttle learning values calculated in each of control sections with each other;

acquiring a variation of an amount in an air inflow flowing from the canister purge valve when the canister purge valve is opened and closed; and determining whether the canister purge valve is stuck based on the variation of the amount in the air inflow.

14. An automotive diagnostic system in a vehicle for diagnosing sticking of a canister purge valve comprising:

a canister for collecting evaporative gas generated in a fuel tank;

a canister purge valve for supplying the evaporative gas in the canister to an engine intake port;

an intake air pressure sensor for measuring an intake air amount flowing into an engine; and an engine control unit for performing control for diagnosing sticking of the canister purge valve, wherein the engine control unit controls opening and closing of the canister purge valve and calculates throttle learning values for acquiring a variation of an amount in an air inflow flowing into the engine in each of control sections;

compares the throttle learning values calculated in each of the control sections with each other;

acquires the variation of the amount in an air inflow flowing from the canister purge valve when the canister purge valve is opened and closed; and determines whether the canister purge valve is stuck based on the variation of the amount in the air inflow, wherein the engine control unit acquires an amount of a first air inflow flowing into the engine based on an output value of the intake air pressure sensor in one of the control sections;

acquires an amount of a second air inflow flowing into the engine based on an opening angle of the throttle in one of the control sections; and calculates a throttle learning value of the canister purge valve by comparing the amount of the first air inflow with the amount of the second air inflow, wherein the automotive diagnostic system in the vehicle uses the determination to monitor the canister purge valve to diagnose a faulty condition to reduce exhaust emissions from the vehicle.

* * * * *